US008960112B2

(12) United States Patent
Brindzik

(10) Patent No.: US 8,960,112 B2
(45) Date of Patent: Feb. 24, 2015

(54) STITCHING SYSTEM AND METHOD FOR STITCH STOP EMBELLISHMENTS

(71) Applicant: VSM Group AB, Huskvarna (SE)

(72) Inventor: Barbara Brindzik, Jonkoping (SE)

(73) Assignee: VSM Group AB (SE)

( * ) Notice: Subject to any disclaimer, the term of this patent is extended or adjusted under 35 U.S.C. 154(b) by 106 days.

(21) Appl. No.: 13/757,245

(22) Filed: Feb. 1, 2013

(65) Prior Publication Data

US 2014/0216318 A1 Aug. 7, 2014

(51) Int. Cl.
*D05C 5/00* (2006.01)
*D05B 19/12* (2006.01)
*D05B 19/08* (2006.01)

(52) U.S. Cl.
CPC ..... *D05B 19/12* (2013.01)
USPC ..... 112/475.19

(58) Field of Classification Search
USPC ..... 112/475.01, 475.17–475.19, 220, 271, 112/102
See application file for complete search history.

(56) References Cited

U.S. PATENT DOCUMENTS

| | | | | |
|---|---|---|---|---|
| 3,570,426 | A | | 3/1971 | Kunes |
| 3,585,950 | A | | 6/1971 | Ito |
| 3,613,608 | A | | 10/1971 | Hinerfeld et al. |
| 3,613,610 | A | * | 10/1971 | Hinerfeld et al. ..... 112/475.05 |
| 3,693,561 | A | | 9/1972 | Hrinko, Jr. et al. |
| 3,712,254 | A | | 1/1973 | Beamish et al. |
| 3,727,567 | A | | 4/1973 | Beazley |
| 3,799,087 | A | | 3/1974 | Beamish et al. |
| 3,815,531 | A | | 6/1974 | Wurst et al. |
| 3,818,849 | A | | 6/1974 | Maddox, Jr. |
| 3,904,890 | A | | 9/1975 | Wenrich et al. |
| 3,967,566 | A | | 7/1976 | Spiegel et al. |
| 4,051,794 | A | | 10/1977 | Herzer et al. |
| 4,073,247 | A | * | 2/1978 | Cunningham et al. ... 112/470.07 |
| 4,092,937 | A | | 6/1978 | Landau, Jr. et al. |
| 4,100,865 | A | | 7/1978 | Landau, Jr. et al. |
| 4,104,976 | A | | 8/1978 | Landau, Jr. et al. |
| 4,108,090 | A | | 8/1978 | Landau, Jr. et al. |
| 4,116,145 | A | | 9/1978 | Nicolay |
| 4,133,275 | A | | 1/1979 | Herzer et al. |
| 4,154,179 | A | | 5/1979 | Arnold |
| 4,160,422 | A | | 7/1979 | Barber et al. |

(Continued)

FOREIGN PATENT DOCUMENTS

| | | |
|---|---|---|
| CA | 1081544 A1 | 7/1980 |
| CA | 2515406 A1 | 8/2004 |

(Continued)

*Primary Examiner* — Ismael Izaguirre
(74) *Attorney, Agent, or Firm* — Lando & Anastasi, LLP

(57) ABSTRACT

Aspects and embodiments of the present invention are directed to systems and methods for embellishing fabric. In accordance with embodiments, a stitching system for a sewing machine is provided comprising a processor configured to control the sewing machine and a user interface configured to receive a stitch selection corresponding to a set of commands executable by the processor to instruct the sewing machine to sew the stitch selection. The set of commands may comprise a first command to sew a first portion of the stitch selection, a second command to stop sewing after completion of the first portion, and a third command to sew a second portion of the stitch selection after completion of the second command. The systems and methods of the present invention may advantageously allow an operator to create a running sequence of perfectly replicated embellishments.

6 Claims, 13 Drawing Sheets

(56) References Cited

U.S. PATENT DOCUMENTS

| | | | | |
|---|---|---|---|---|
| 4,181,085 | A | 1/1980 | Conner, Jr. | |
| 4,185,575 | A | 1/1980 | Brown et al. | |
| 4,195,582 | A | 4/1980 | Novick et al. | |
| 4,214,540 | A | 7/1980 | Cook | |
| 4,221,176 | A * | 9/1980 | Besore et al. | 112/102.5 |
| 4,351,254 | A | 9/1982 | Brown | |
| 4,352,334 | A | 10/1982 | Childs et al. | |
| 4,359,008 | A | 11/1982 | Newman | |
| 4,365,565 | A | 12/1982 | Kawai et al. | |
| 4,369,722 | A * | 1/1983 | Nishida et al. | 112/103 |
| 4,373,458 | A | 2/1983 | Dorosz et al. | |
| 4,373,459 | A | 2/1983 | Dunn et al. | |
| 4,391,215 | A | 7/1983 | Sansone | |
| 4,393,343 | A | 7/1983 | Angersbach et al. | |
| 4,412,498 | A | 11/1983 | Scholl | |
| 4,457,246 | A | 7/1984 | Hanyu et al. | |
| 4,503,794 | A | 3/1985 | Ishihara et al. | |
| 4,507,596 | A | 3/1985 | Angersbach et al. | |
| 4,509,443 | A | 4/1985 | Martell et al. | |
| 4,513,676 | A | 4/1985 | Martell et al. | |
| 4,519,331 | A | 5/1985 | Kosrow et al. | |
| 4,526,114 | A | 7/1985 | Martell et al. | |
| 4,526,116 | A | 7/1985 | Ma/ nnel | |
| 4,555,997 | A | 12/1985 | Tancs | |
| 4,557,207 | A | 12/1985 | Turner et al. | |
| 4,563,964 | A | 1/1986 | Sjodin | |
| 4,622,907 | A | 11/1986 | Kimura | |
| 4,648,337 | A | 3/1987 | Mall | |
| 4,682,554 | A | 7/1987 | Goto et al. | |
| 4,686,917 | A | 8/1987 | Braun | |
| 4,706,584 | A | 11/1987 | Senda et al. | |
| 4,726,307 | A | 2/1988 | Yamauchi | |
| 4,726,309 | A | 2/1988 | Popp | |
| 4,742,786 | A | 5/1988 | Hashimoto et al. | |
| 4,748,920 | A | 6/1988 | Stutznacker | |
| 4,757,773 | A | 7/1988 | Nomura et al. | |
| 4,781,130 | A | 11/1988 | Badowski | |
| 4,794,875 | A | 1/1989 | Noguchi et al. | |
| 4,803,937 | A | 2/1989 | Hiramatsu et al. | |
| 4,815,406 | A | 3/1989 | Brown et al. | |
| 4,834,008 | A | 5/1989 | Sadeh et al. | |
| 4,841,891 | A | 6/1989 | Hashimoto et al. | |
| 4,849,902 | A | 7/1989 | Yokoe et al. | |
| 4,860,678 | A | 8/1989 | Skogward | |
| 4,867,082 | A | 9/1989 | Sabbioni et al. | |
| 4,867,087 | A | 9/1989 | Suzuki et al. | |
| 4,932,343 | A | 6/1990 | Mardix et al. | |
| 4,982,677 | A | 1/1991 | Nomura et al. | |
| 4,995,328 | A | 2/1991 | Tanaka | |
| 5,000,105 | A | 3/1991 | Tanaka | |
| 5,012,752 | A | 5/1991 | Murata et al. | |
| 5,018,466 | A | 5/1991 | Hasegawa | |
| 5,095,835 | A | 3/1992 | Jernigan et al. | |
| 5,138,962 | A | 8/1992 | Klundt | |
| 5,146,862 | A | 9/1992 | Sato et al. | |
| 5,156,106 | A | 10/1992 | Suzuki et al. | |
| 5,156,107 | A | 10/1992 | Kyuno et al. | |
| 5,184,560 | A | 2/1993 | Asano | |
| 5,270,939 | A | 12/1993 | Goldberg et al. | |
| 5,303,665 | A | 4/1994 | Hausammann | |
| 5,319,565 | A | 6/1994 | Hausammann et al. | |
| 5,323,722 | A | 6/1994 | Goto et al. | |
| 5,347,940 | A | 9/1994 | Hori et al. | |
| 5,389,868 | A | 2/1995 | Mikami et al. | |
| 5,410,976 | A | 5/1995 | Matsubara | |
| 5,474,005 | A | 12/1995 | Yamauchi et al. | |
| 5,477,795 | A | 12/1995 | Nakayama et al. | |
| 5,537,939 | A | 7/1996 | Horton | |
| 5,537,946 | A | 7/1996 | Sadeh et al. | |
| 5,562,059 | A | 10/1996 | Yamauchi et al. | |
| 5,571,240 | A | 11/1996 | Yamauchi et al. | |
| 5,588,383 | A | 12/1996 | Davis et al. | |
| 5,592,891 | A | 1/1997 | Muto | |
| 5,603,272 | A | 2/1997 | Takahashi et al. | |
| 5,653,186 | A | 8/1997 | Yamauchi et al. | |
| 5,701,830 | A | 12/1997 | Muto | |
| 5,740,055 | A | 4/1998 | Iwata | |
| 5,755,240 | A | 5/1998 | Schonborn | |
| 5,791,270 | A | 8/1998 | Mori | |
| 5,911,182 | A | 6/1999 | Uyama et al. | |
| 5,915,315 | A * | 6/1999 | Bentz | 112/103 |
| 5,924,372 | A | 7/1999 | Okuda et al. | |
| 5,974,997 | A | 11/1999 | Amburgey | |
| 6,032,595 | A | 3/2000 | Okuyama | |
| 6,131,526 | A | 10/2000 | Iida et al. | |
| 6,135,038 | A | 10/2000 | Okamoto | |
| 6,189,989 | B1 | 2/2001 | Hirabayashi et al. | |
| 6,202,001 | B1 | 3/2001 | Muto | |
| 6,209,468 | B1 | 4/2001 | Marcangelo et al. | |
| 6,293,210 | B1 | 9/2001 | Freeman et al. | |
| 6,321,670 | B1 | 11/2001 | Tomita et al. | |
| 6,381,818 | B1 | 5/2002 | Freeman et al. | |
| 6,718,895 | B1 | 4/2004 | Fortuna | |
| 6,729,255 | B2 | 5/2004 | Ton et al. | |
| 6,732,668 | B2 | 5/2004 | Zesch et al. | |
| 6,823,807 | B2 | 11/2004 | Zesch et al. | |
| 6,871,605 | B1 | 3/2005 | Zesch et al. | |
| 6,883,446 | B2 | 4/2005 | Koerner | |
| 6,883,449 | B2 | 4/2005 | Burrell et al. | |
| 6,963,790 | B2 | 11/2005 | Mizuno et al. | |
| 6,983,192 | B2 | 1/2006 | Block et al. | |
| 7,210,417 | B2 | 5/2007 | Koerner | |
| 7,212,880 | B2 | 5/2007 | Mizuno et al. | |
| 7,240,628 | B2 | 7/2007 | Friman et al. | |
| 7,308,333 | B2 | 12/2007 | Kern et al. | |
| 7,412,936 | B2 | 8/2008 | Price et al. | |
| 7,460,925 | B2 | 12/2008 | Noguchi | |
| 7,793,602 | B2 | 9/2010 | Koemer | |
| 7,814,832 | B2 | 10/2010 | Franz | |
| 8,261,679 | B2 | 9/2012 | Ihira et al. | |
| 8,387,547 | B2 | 3/2013 | Bardh et al. | |
| 2002/0043202 | A1 | 4/2002 | Freeman et al. | |
| 2003/0140829 | A1 | 7/2003 | Zesch et al. | |
| 2003/0140831 | A1 | 7/2003 | Zesch et al. | |
| 2003/0140832 | A1 | 7/2003 | Ton et al. | |
| 2004/0210336 | A1 | 10/2004 | Block et al. | |
| 2005/0016428 | A1 | 1/2005 | Koerner | |
| 2006/0064195 | A1 * | 3/2006 | Kern et al. | 700/138 |
| 2006/0213413 | A1 | 9/2006 | Koerner | |
| 2007/0204781 | A1 | 9/2007 | Noguchi | |
| 2007/0245940 | A1 | 10/2007 | Wahlstrom | |
| 2007/0256619 | A1 | 11/2007 | Koemer | |
| 2010/0224111 | A1 | 9/2010 | Ihira et al. | |
| 2011/0005441 | A1 | 1/2011 | Roche | |
| 2011/0041746 | A1 | 2/2011 | Eklund et al. | |
| 2011/0146553 | A1 | 6/2011 | Wilhelmsson et al. | |
| 2011/0168070 | A1 | 7/2011 | Lanquist | |
| 2011/0303138 | A1 | 12/2011 | Flygare et al. | |
| 2012/0060733 | A1 | 3/2012 | Maki et al. | |
| 2012/0060734 | A1 | 3/2012 | Yamanashi et al. | |
| 2012/0234222 | A1 | 9/2012 | Naka | |
| 2013/0014682 | A1 | 1/2013 | Brindzik | |
| 2013/0042797 | A1 | 2/2013 | Bondesson et al. | |

FOREIGN PATENT DOCUMENTS

| | | | |
|---|---|---|---|
| DE | 102007001073 | A1 | 8/2007 |
| EP | 77788 | A1 | 5/1983 |
| EP | 103364 | A2 | 3/1984 |
| EP | 117713 | A1 | 9/1984 |
| EP | 124211 | A1 | 11/1984 |
| EP | 366140 | A1 | 5/1990 |
| EP | 515131 | A1 | 11/1992 |
| EP | 564771 | A2 | 10/1993 |
| EP | 857228 | A1 | 8/1998 |
| EP | 1184502 | A1 | 3/2002 |
| EP | 1777331 | A1 | 4/2007 |
| EP | 2226419 | A1 | 9/2010 |
| GB | 1320764 | A | 6/1973 |
| GB | 1349994 | A | 4/1974 |
| GB | 1375540 | A | 11/1974 |
| GB | 1393294 | A | 5/1975 |
| GB | 1440350 | A | 6/1976 |
| GB | 1475791 | A | 6/1977 |

(56) References Cited

FOREIGN PATENT DOCUMENTS

| | | | |
|---|---|---|---|
| GB | 1526209 | A | 9/1978 |
| GB | 1547931 | A | 7/1979 |
| GB | 1547932 | A | 7/1979 |
| GB | 1547933 | A | 7/1979 |
| GB | 1547934 | A | 7/1979 |
| GB | 1568486 | A | 5/1980 |
| GB | 1570241 | A | 6/1980 |
| GB | 1570242 | A | 6/1980 |
| GB | 1570243 | A | 6/1980 |
| GB | 1570244 | A | 6/1980 |
| GB | 1570245 | A | 6/1980 |
| GB | 1571736 | A | 7/1980 |
| GB | 2043124 | A | 10/1980 |
| GB | 1583629 | A | 1/1981 |
| GB | 2157723 | A | 10/1985 |
| GB | 2168085 | A | 6/1986 |
| GB | 2177520 | A | 1/1987 |
| GB | 2204604 | A | 11/1988 |
| JP | 1212591 | A | 8/1989 |
| JP | 02055080 | A | 2/1990 |
| JP | 6304359 | A | 11/1994 |
| JP | 2000167277 | A | 6/2000 |
| JP | 2000342869 | A | 12/2000 |
| JP | 2009011594 | A | 1/2009 |
| JP | 2009233435 | A | 10/2009 |
| JP | 2010185151 | A | 8/2010 |
| KR | 198800714 | B1 | 4/1988 |
| WO | 8901067 | A1 | 2/1989 |
| WO | 9715708 | A1 | 5/1997 |
| WO | 0104405 | A1 | 1/2001 |
| WO | 2004072349 | A2 | 8/2004 |
| WO | 2006071786 | A2 | 7/2006 |
| WO | 2007143062 | A2 | 12/2007 |
| WO | 2010144013 | A1 | 12/2010 |

* cited by examiner

Appliqué Flow Chart

Ribbon Flow Chart

Pop up Stitch Flow Chart

STITCHING SYSTEM AND METHOD FOR STITCH STOP EMBELLISHMENTS

FIELD OF THE DISCLOSURE

Aspects and embodiments relate generally to sewing, and more specifically to systems and methods for using a computerized sewing machine to create embellishments.

BACKGROUND

In sewing, there are many known ways of embellishing a piece of fabric. Commonly, a piece of base material, for example, the blanket portion of a quilt or the fabric that makes up a skirt will be embellished with an ornamental design. For example, the base material may be embellished with a smaller swatch of cloth applied to the base material and stitched in place to create a design, pattern, or picture. This technique is generally known as appliqué. Generally, appliqué techniques are very time consuming and performed by hand.

Similarly, other materials, such as ribbon or "pop up" pieces of fabric, may be sewn onto a base piece to create a desired visual affect. Several presser feet have been developed for the purpose of applying ribbon with a sewing machine, however these feet are generally made such that an operator has to thread the ribbon through the presser foot and sew the ribbon onto the base piece with a straight stitch or a zigzag stitch. The presser foot guides the ribbon along the base material. Thus when using these presser feet, an operator is limited in the ways in which they may apply the ribbon. If a wider stitch or more ornate application is desired, the embellishment must generally be created by hand.

Generally, embellishments are manually created. Embellishing garments is therefore time consuming, and manually created designs are difficult to reproduce with precision and accuracy.

SUMMARY

In accordance with one or more aspects and embodiments, a stitching system for a computerized sewing machine is provided. The sewing machine comprises a processor configured to control the sewing machine and a user interface configured to receive a stitch selection corresponding to a set of commands executable by the processor. The set of commands executable by the processor instruct the sewing machine to sew the stitch selection. The set of commands executed by the processor may comprise a first command to sew a first portion of the stitch selection, a second command to stop sewing after completion of the first portion, and a third command to sew a second portion of the stitch selection after completion of the second command.

In accordance with one or more aspects and embodiments, a method for decorative sewing with a sewing machine is provided comprising positioning a workpiece on the sewing machine, selecting a stitch pattern, and inputting the selected stitch pattern into the sewing machine through a user interface. The method further comprises operating the sewing machine to sew a first portion of the selected stitch pattern onto the workpiece, receiving from the sewing machine a signal after the first portion of the selected stitch pattern is completed, and operating the sewing machine to sew a second portion of the stitch pattern onto the workpiece after receiving the signal from the sewing machine.

In accordance with one or more aspects and embodiments, a non-transitory computer readable storage medium is provided comprising at least one set of instructions corresponding to a stitch pattern executable by a processor and selectable by a user interface. The set of instructions further being operable to instruct the processor to execute a set of commands to a sewing machine, wherein the set of commands comprise a first command to sew a first portion of the stitch selection, a second command to stop sewing after completion of the first portion, and a third command to sew a second portion of the stitch selection after completion of the second command.

In accordance with one or more aspects and embodiments, a method of facilitating decorative sewing is provided comprising providing a sewing machine comprising a processor configured to control the sewing machine and a user interface configured to receive a stitch selection corresponding to a set of commands executed by the processor. The set of commands may comprise a first command to sew a first portion of the stitch selection, a second command to stop sewing after completion of the first portion, and a third command to sew a second portion of the stitch selection after completion of the second command, and the method may further comprise instructing an operator to engage the user interface to input a stitch selection and initiate the set of commands.

BRIEF DESCRIPTION OF THE DRAWINGS

In the drawings, like reference characters generally refer to the same parts throughout the different views. Also, the drawings are not necessarily to scale, emphasis instead generally being placed upon illustrating principles and are not intended as a definition of the limits of the invention. For purposes of clarity, not every component may be labeled in every drawing. In the following description, various aspects and embodiments are described with reference to the following drawings, in which.

DETAILED DESCRIPTION

Figure 1:
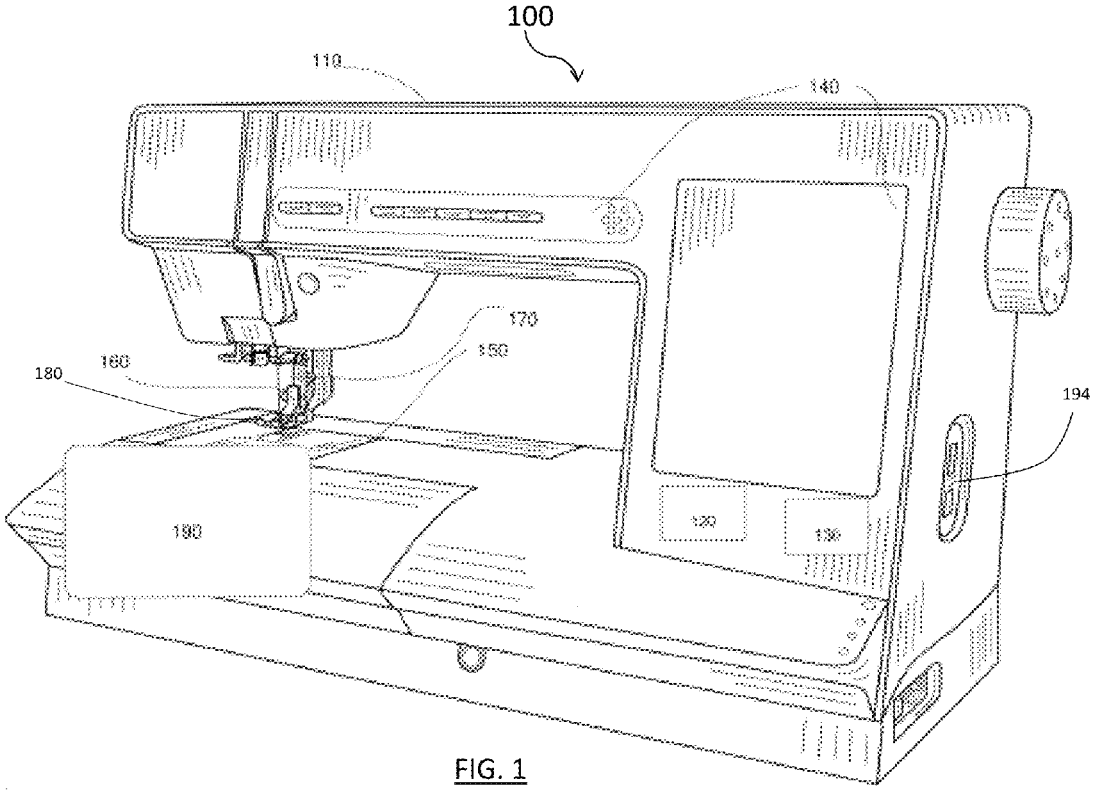
FIG. 1 shows a sewing machine in accordance with aspects and embodiments.

In accordance with aspects and embodiments, stitching systems, processes, and methods are provided for creating embellishments. The systems, processes, and methods disclosed may include use of a computerized sewing machine that allows for the precise and accurate replication of embellishments. As used herein, an embellishment refers to an ornamental design applied to a workpiece. A workpiece is the base material being sewn, and may be for example, the material comprising a skirt or the blanket portion of a quilt.

There are numerous types of embellishments known in the art. As used herein, an appliqué refers to an embellishment comprised of an additional material, for example, fabric of a different color than the workpiece, affixed to the workpiece by stitches. The appliqués may be affixed to the workpiece by stitches executed by a computerized sewing machine. The systems, processes, and methods of the present disclosure may advantageously allow an operator to create a running stitch of embellishments, for example sequential, connected, and perfectly-replicated appliqués. The systems, processes, and methods disclosed are particularly advantageous over traditional methods of appliqué embellishment because they have the ability to create sequential appliqués without the necessity of having to remove the excess appliqué material surrounding the embellishment after the creation of each individual appliqué.

The stitching systems disclosed also allow an operator to create other embellishments that incorporate ribbon and other material. Generally, when ribbon is applied with a sewing machine, the operator is required to feed the ribbon through the presser foot of the sewing machine. This greatly limits the ways in which an operator can affix the ribbon to the workpiece. The systems, processes, and methods of ribbon embellishment may allow an operator to create ribbon embellishments without being limited by traditional ribbon presser feet. The stitching systems disclosed may further allow an operator to create pop-up embellishments. As used herein, a pop-up embellishment is an appliqué wherein a swatch of fabric that is stitched to a workpiece is affixed such that it creates a three dimensional ornament.

Generally, appliqués, pop-up stitches, and ribbon designs are completed by conventional hand sewing techniques. These hand sewing techniques are time consuming and necessarily less accurate and precise than those performed by a computerized sewing machine.

For example, traditional appliqués are created manually. A piece of fabric is chosen as the appliqué fabric and is generally cut into a desired design. The cut design is then placed on the garment to be appliqué d, the workpiece, and the design is stitched onto the workpiece either manually, or with the assistance of a sewing machine. The sewing machine may be mechanical or computer-based, and the stitches used to affix the appliqué onto the workpiece are generally positioned around the perimeter of the design such that the stitches form the outer boundary of the embellishment. Care must be taken to stitch precisely and exactly around the perimeter of the design to create a clean, professional-looking, embellishment.

If another appliqué is desired, another piece of fabric must be cut into the desired design and affixed onto the workpiece. Each time a design is cut out from material or affixed onto a workpiece, there is room for operator error that necessarily leads to imprecision and inaccuracies in the overall design. These imperfections reduce the quality of the finished product. Furthermore, cutting out each piece of fabric to appliqué is time consuming and performing precise, uniform, stitching around each appliqué is challenging, when done by machine or by hand.

In the alternative, if an un-shaped piece of appliqué fabric was placed on top of a workpiece and a desired design was stitched over the fabric to affix it to the workpiece, the excess fabric surrounding the design would have to be trimmed before the operator could continue sewing. The operator would have to remove the workpiece from the machine, remove the excess fabric, and then resume sewing. In order to create a uniform sequence of embellishments, any stitches sewn after the appliqué stitches would need to begin exactly where the last appliqué stitch was completed. This method of embellishment again requires careful maneuvering by the operator to create uniform stitched designs and leads to imperfections, both when the design is stitched and when the operator resumes sewing.

In accordance with certain aspects and embodiments, a stitching system is provided for the creation and replication of precise, accurate embellishments. The stitching systems may be executed by a sewing element, including, but not limited to, a computerized sewing machine that comprises a processor. The processor may be configured to control sewing elements of the sewing machine. The processor may, for example, control the needle, needle bar, presser foot, and related elements of the sewing machine that cause stitches to be created. The processor may be configured to execute commands that correspond to selections input into the machine by an operator. The commands may instruct the machine to sew a certain pattern that facilitates the creation of an embellishment.

In accordance with certain aspects and embodiments, the sewing machine may include a user interface that enables an operator to input stitch selections. The user interface may comprises a digital screen that may be operated by a stylus or by an operator's touch, or the user interface may comprise a screen and a series of buttons or dials that allow an operator to make input selections. The contemplated user interfaces are capable of displaying to an operator a visual representation of stitch patterns as they may appear when sewn onto a workpiece.

The stitch pattern selected may correspond to a stitch file. A stitch file may contain both the visual representation of the stitch pattern displayed to a user and contain the stitch report executed by the processor of the sewing machine to create the embellishment. Stitch files may be stored in the internal memory of the computerized sewing machine, or may be stored on an external memory device capable of communication with the machine. The sewing machines may connect to a computer, a mass storage device, including but not limited to a USB stick or external hard drive, may read information from a CD, or may connect to the internet via a wired or wireless connection. Stitch files may be uploaded onto the machine after being downloaded from the internet. Further, the processor of the sewing machine may execute commands contained in a stitch file, regardless of where the stitch file is stored. For example, the sewing machine may execute a stitch file stored on a USB device in communication with the sewing machine without the stitch file being uploaded and stored in the memory of the sewing machine.

The stitch reports of stitch files may comprise sets of commands executable by the processor such that each command causes the sewing machine to create a sequential portion of the stitch selection to create a complete embellishment.

The stitch reports may comprise commands that cause the sewing elements of the sewing machine to sew a portion of the stitch selection as well as commands that cause the sewing elements to stop sewing after completion of a portion of the stitch selection. For example, a stitch report may comprise three unique commands: a first command to sew a first portion of the stitch selection, a second command to stop sewing after completion of the first portion of the stitch selection, and a third command to sew a second portion of the stitch selection after completion of the stop command. These three commands may complete the embellishment, or there may be more commands in the stitch report that the sewing machine may execute to complete the stitch selection and thus complete the embellishment.

After an operator inputs a stitch selection into the sewing machine, the sewing machine will automatically execute the first command of the stitch report when the operator begins to sew. The operator may begin sewing by engaging a foot pedal in communication with sewing machine or, alternatively, the machine may comprise a start button or other features that cause the sewing elements of the sewing machine to create stitches.

In accordance with some embodiments, signals may be generated and output by the sewing machine contemporaneously with the processor's execution of the stitch report commands. For example, an operator may receive from the machine a signal and act in a way to facilitate completion of the desired embellishment.

The signal may be a mechanical output generated by the sewing machine. For example, the machine may reduce the sewing speed or stop sewing. An operator may, in accordance with embodiments, respond to the machine's change and perform a task. In the alternative, the machine may produce an audible signal that signals the operator to act. In accordance with some embodiments, the signal may be computerized. A signal may, for example, be displayed on the user interface. The signal may comprise words, pictures, or other indicia that assist and prompt the operator.

The commands and signals of aspects and embodiments may facilitate the creation of an embellishment.

For example, and in accordance with aspects and embodiments, a processor-executed stop command may, in and of itself, provide a signal to the operator, or, may be coupled with a signal that directs the operator to perform a task to facilitate completion of an embellishment. In some embodiments, in response to a specific signal, an operator may place a piece of material in a specific location relative to the sewing needle. In some embodiments, in response to a specific signal, the operator may re-orient a workpiece being embellished. The material may be appliqué material, ribbon, pop-up material, or any other embellishment material. Once the operator has completed the task signaled by the machine, the operator may resume sewing. By causing the machine to resume sewing, the processor necessarily executes the next command in the stitch report. The sequential command may, for example, affix the material placed on the workpiece by the operator in response to a previously received signal.

In accordance with aspects and embodiments, when the processor executes a stop command in the stitch report, the command may cause elements of the sewing machine to stop in certain, advantageous positions. For example, the sewing needle of the sewing machine may stop in the down position, such that it pierces the workpiece and holds the workpiece in place. This ensures that when the machine resumes sewing, there will not be any variation in the stitch length created by the sewing machine. This feature may assist an operator in creating an embellishment and further ensure that sequential embellishments are identical in appearance.

In accordance with some embodiments, a stop command may further cause the presser foot of the sewing machine to rise off the workpiece. When sewing, the presser foot exerts pressure on the workpiece, facilitates the guiding of the workpiece over the sewing surface of the sewing machine, and assists the operator in directing the workpiece under the sewing needle in the desired directions. When an operator has finished sewing, the operator raises the presser foot off the workpiece. The operator may raise the presser foot manually, by for example, lifting a lever, or the presser foot may be raised by pressing a button on the sewing machine. When an operator completes sewing, and raises the presser foot, the operator generally raises the presser foot to its highest elevation.

In accordance with aspects and embodiments, when the processor executes a stop command in the stitch report, the stop command may cause the presser foot to rise off the workpiece after the machine stops sewing. This may allow the operator to perform an action to create an embellishment. The presser foot may rise to a height above the workpiece that is less than the height of its fully elevated position, and may, for example rise off the workpiece in amount sufficient to allow the operator to place embellishment material under the presser foot. The presser foot may rise to a height that is pre-programmed in the stitch report commands, or may rise to a height that is input by an operator to allow a certain type of material to be positioned under the presser foot for creation of a desired embellishment. The presser foot may, in some embodiments, raise to a height to allow thicker materials, such as denim and leather, to be inserted under the presser foot, or may, in some embodiments, raise to a lower level to allow thinner materials, such as cotton and ribbons, to be placed by the needle. The presser foot may be configured to rise to an amount that allows embellishment material to be placed on the workpiece, but does not allow an excess of movement of the material under the presser foot. In accordance with some embodiments, the presser foot may raise in a range of about 1 mm to about 10 mm off of the workpiece; about 1 mm to about 5 mm off of the workpiece; and, most preferably about 2 mm off of the workpiece. Commands that follow a command to raise the presser foot may cause the presser foot to return to the down position before further stitches are executed. In the alternative, the presser foot may be raised or lowered manually in response to signals received by the operator.

In accordance with more specific aspects and embodiments, FIG. 1 shows an example of a stitching system 100. The stitching system 100 may comprise a computerized sewing machine 110 that includes a memory 120 (represented by a box), a processor 130 (represented by a box), a user interface 140, a sewing surface 150, a needle 160, and thread 170 that is fed from a spool (not shown). Memory 120 and processor 130 are typically internal components of sewing machine 110 and are shown in FIG. 1 for illustrative purposes only. Workpiece 190 is the fabric or garment onto which an embellishment is created. Presser foot 180 (shown in a raised position) exerts pressure on workpiece 190 during sewing and assists in guiding workpiece 190 under needle 160. Sewing system 100 may include additional components and include other functionalities in addition to the exemplary stitching systems and methods described. Sewing system 100 may, for example, include a foot pedal in communication with sewing machine 110 that allows an operator to control functions of the machine. Sewing system 100 may also include, for example, a series of in-out devices that command sewing machine 110 to perform certain functions, including but not limited to starting and stopping the machine, raising and lowering the presser foot, raising and lowering the needle, and tying off threads. The stitching system 100 may also include a connection 194 that enables sewing machine 110 to receive stitch files from an external source. Connection 194 may be, for example, a USB port, a CD drive, an internet connection, or other feature to enable an operator to create embellishments not already stored in memory 120.

Processor 130 may be any type of electronic circuit or component capable of performing the functions described herein. Examples include, but are not limited to, processors, microprocessors, controllers, application specific integrated circuits ("ASICs"), and integrated circuits. Similarly, the memory 120 may be any type of electronic circuit that is capable of storing data. For example, memory 120 may be, but is not limited to, any type of hard drive, flash memory, array, or dynamic random access memory ("DRAM").

User interface 140 may be any component that allows the operator to input selections into sewing machine 110 and receive feedback signals from sewing machine 110. For example, a feedback signal could be the machine automatically coming to a stop, or could alternatively be a prompt displayed on a screen of user interface 140. User interface 140 may include a touch screen, depressible buttons or levers, a selection grid, or other features that enable an operator to make selections and operate system 100. In system 100, user interface 140 is shown as two separate components, a touch screen and a series of input devices, for example, buttons.

Memory 120 may store any number of pre-programmed stitch files that may be performed by sewing machine 110. Each of the pre-programmed stitch files may include a stitch report that comprises a set of commands executable by the processor 130 and a corresponding visual representation of the stitch pattern that is displayed to the operator. Each stitch report corresponds to a stitch pattern that may be created by stitching system 100 and may be displayed on user interface 140 in advance of the operator creating the pattern. In addition, memory 120 may also store operator-generated stitch files based on inputs received from an operator using a stitch-creating program.

An operator may place a workpiece 190 onto which an embellishment is to be created onto the sewing surface 150 and then select, via the user interface 140, a stitch pattern to be created on workpiece 190. User interface 140 may display a visual representation of the stitch pattern so that the operator may verify that the selection will result in the desired embellishment. In addition, the operator may have the ability, via the user interface 140, to make adjustments to the stitch patterns, such as adjustments to the pattern's length, width, and stitch density. These adjustments may then be displayed on the user interface 140 to allow the operator to verify that the adjustments will create the operator's desired embellishment. The display of adjustments on the user interface 140 may show the adjustments made in a numerical form, for example, the length and width of the stitch patterns may be shown on user interface 140 in inches or centimeters, or the user interface 140 may simply display an adjusted visual representation of the stitch pattern as it will appear on the workpiece.

Figure 2:
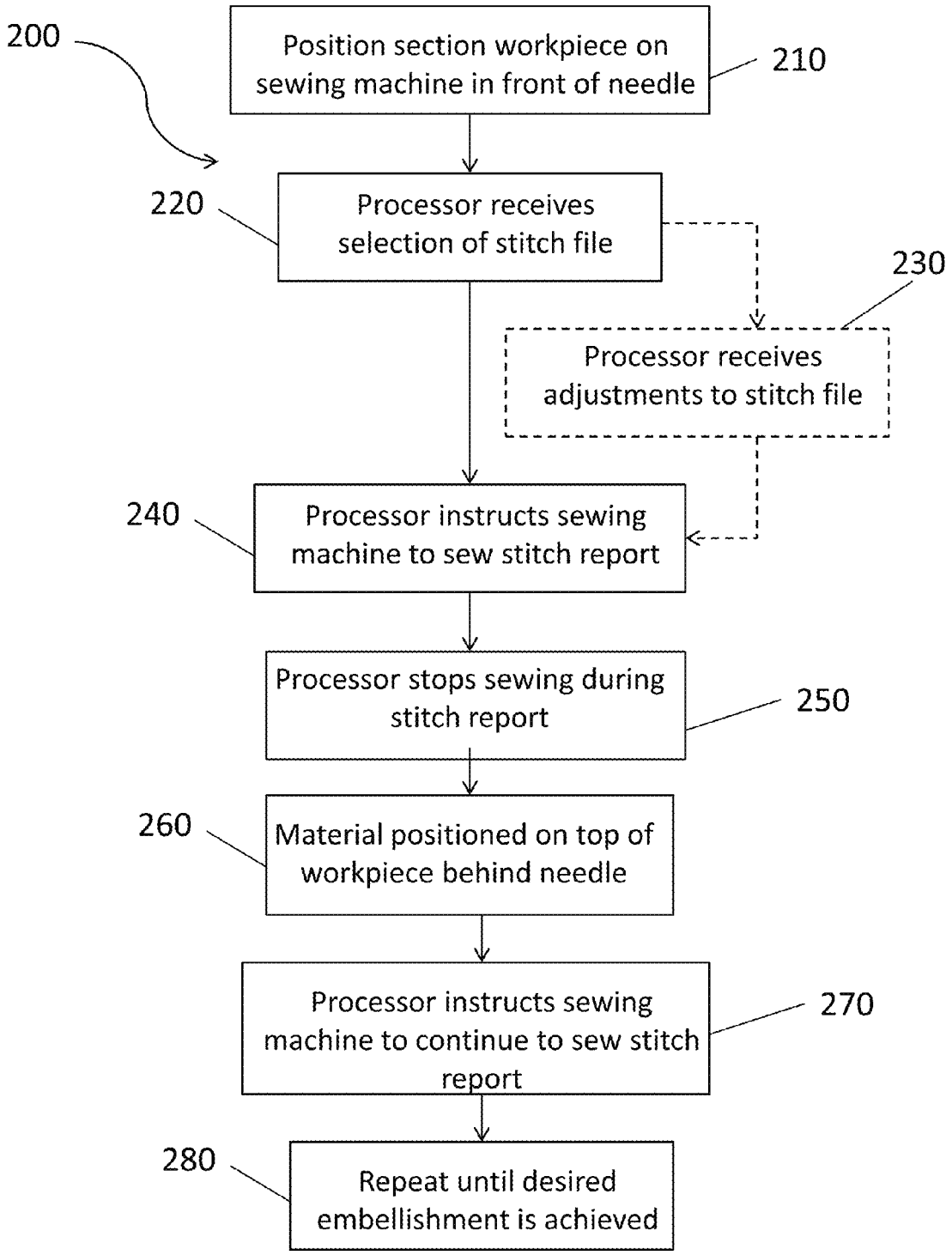
FIG. 2 shows a process of appliqué embellishment including processor-executable commands according to aspects and embodiments.

In accordance with aspects and embodiments, FIG. 2 shows process 200, executable by the stitching systems disclosed. The commands of process 200 are described in relation to system 100 and its corresponding elements. Process 200 creates embellishments using a computerized sewing machine 110. Process 200 includes selections input into sewing machine 110 by an operator that cause processor 130 to execute a series of commands to cause sewing system 100 to create an embellishment. More specifically, process 200 creates appliqué embellishments and has the ability to create a running stitch of sequential, perfectly replicated, embellishments that comprise appliqué. Beginning with step 210, a workpiece to be embellished, such as workpiece 190, is positioned within the computerized sewing machine 110. Specifically, an operator may place workpiece 190 onto the sewing surface 150 such that the section of the workpiece to be embellished is positioned in front of the sewing needle 160.

At step 220, processer 130 of system 100 may receive a selection of a stitch pattern. The visual representation of the selected stitch pattern may be part of a stitch file that contains a stitch report comprising commands executable by the processor and configured to stitch the selected pattern onto workpiece 190. The stitch file may be stored within memory 120 as a pre-programmed stitch pattern, be read from an external memory device connected to the machine, or, alternatively, may be an operator-generated custom design. The processor 130 may receive the selection of the stitch pattern via the user interface 140. The operator may input the stitch pattern selection by touching digital icons on a screen of the user interface 140 or may press push-buttons of the user interface.

In an optional step 230, processor 130 may receive an adjustment to the stitch report. The adjustments may include an adjustment to the dimensions of the stitch pattern, the entry of a starting or ending position in the stitch pattern, or other features adjustable and customizable by the operator. In accordance with embodiments, the operator may employ user interface 140 to adjust the length and/or width of the selected stitch pattern. For example, depending on the location of the garment onto which the operator desires to create an embellishment, the length, width, and overall size of the stitch pattern may be adjusted to create a desired visual effect. The operator may, for example, adjust the length, width, and size of the stitch pattern to best suit the area sought to be embellished. Processor 130 receives operator inputted adjustments to the stitch pattern and alters the stitch report in the stitch file as needed.

After selecting a stitch pattern and making any necessary adjustments, the operator begins to sew. The operator, may, for example, begin sewing by engaging a foot pedal in communication with sewing machine 110, or, alternatively, the processer may execute a command in response to an operator pressing a start button on the machine. Starting to sew causes processor 130 to execute command 240 that instructs sewing machine 110 to sew a first portion of the stitch pattern onto workpiece 190. Sewing needle 160 then sews thread 170 from the spool into the pattern that corresponds to the stitch report command.

Processor 130 may then execute a next command 250 that instructs sewing machine 110 to stop sewing after the first portion of the stitch pattern is complete. The stitch report contemplated in process 200 has one stop command, but other stitch reports may contain more than one stop commands. Sewing needle 160 stops in the needle down position and presser foot 180 raises off workpiece 190. Presser foot 180 does not elevate completely. Instead, presser foot 180 rises in an incremental amount that allows an operator to perform a sequential step 260 to place an appliqué material behind the sewing needle. Presser foot 180, may, in some embodiments, raise above workpiece 190 in a range of about 1 mm to about 5 mm, and more preferably, about 2 mm, to allow an operator to complete step 260.

After an operator completes step 260, the operator resumes sewing. Resuming sewing causes processor 130 to execute command 270 and the processor 130 causes sewing machine 110 to complete the stitch report corresponding to the stitch pattern selected by the user. The execution of command 270 causes an appliqué material to be affixed to the workpiece. Process 200 can be repeated in step 280 until the operator has completed a desired number of appliqué embellishments.

Process 200 performed by stitching system 100 advantageously allows an operator to create a sequence of perfectly spaced, identically replicated, embellishments. Because appliqué material is placed behind sewing needle 160, the operator may continue to create appliqué embellishments without having to remove excess appliqué fabric in between repetitions of the selected stitch pattern. This enables the operator to create embellishments without interruption of sewing.

Figure 3A:
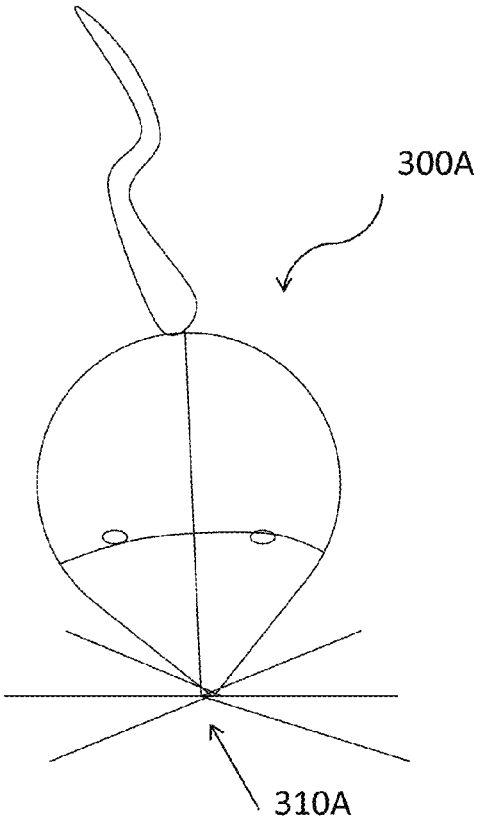
FIGS. 3A and 3B show appliqué stitch patterns in accordance with aspects and embodiments.
Figure 3B:
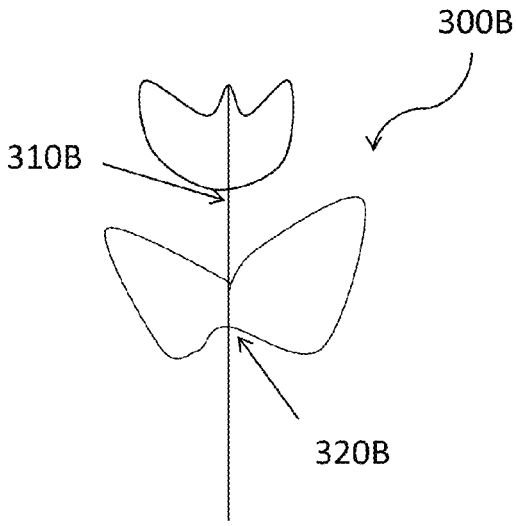

For example and referring also to FIGS. 3A and 3B, an operator may select an appliqué stitch pattern 300A or 300B that corresponds to a processor-executed series of commands in accordance with process 200. The operator may perform method 400 to cause sewing machine 110 having processor 130 to execute the stitch report corresponding to pattern 300A or 300B and sew stitch pattern 300A or 300B onto a workpiece 190 (not shown).

Stitch pattern 300A and stitch pattern 300B may correspond to a series of processor-executed commands that cause sewing machine 110 to stop at certain times in the stitch report.

For example, and referring to FIG. 3A, stitch pattern 300A may have one stop point, 310A, which may, for example, correspond to stop command 250 in process 200. Stitch pattern 300B may have two stop points, 310B and 320B, which correspond to two separate and distinct stop commands executed by the processor in the corresponding stitch report. After each stop in an appliqué stitch report, the operator places appliqué material behind the sewing needle. A stitch report may contain any number of stop commands, depending on the desired embellishment.

Figure 4A:
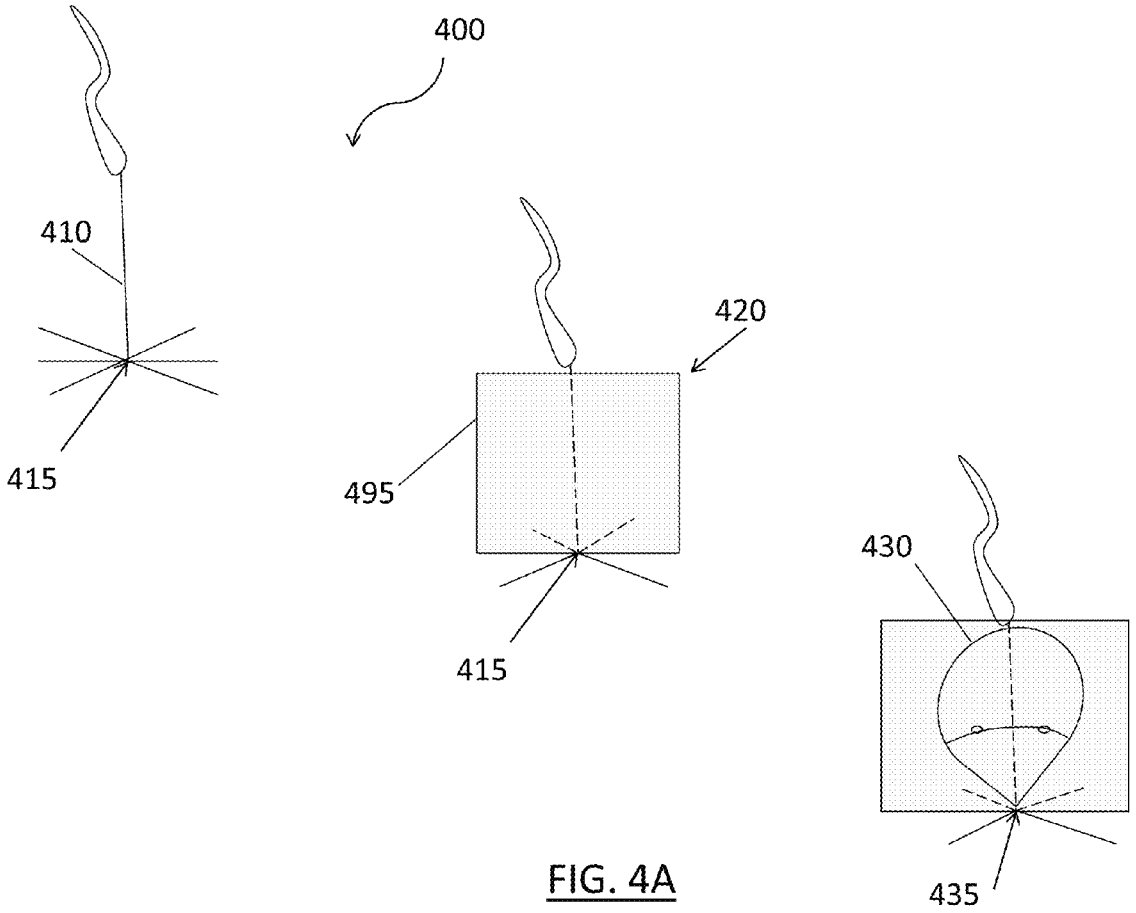
FIGS. 4A-4B show a method of appliqué embellishment in accordance with aspects and embodiments.
Figure 4B:
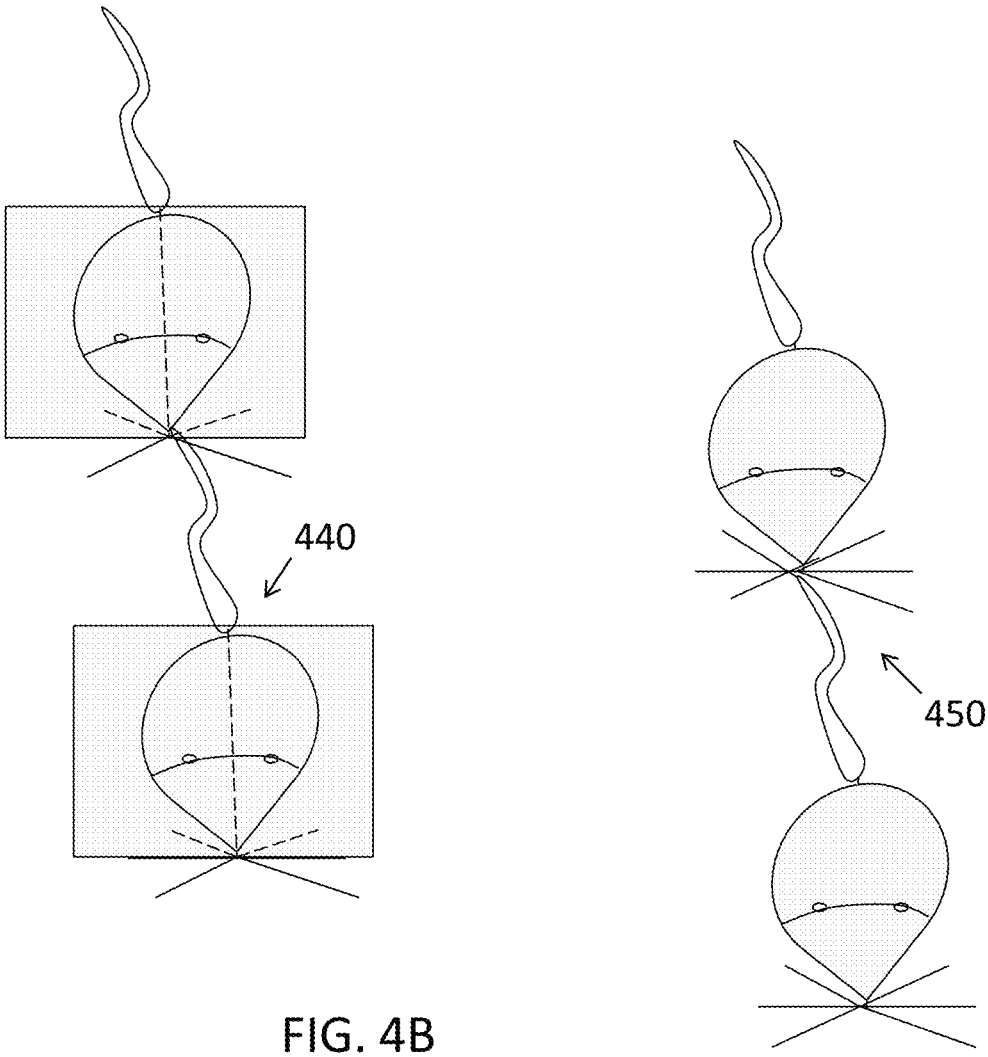

Referring to FIGS. 4A and 4B, method of appliqué 400 will be described in relation to a stitch pattern comprising one stop point, such as stitch pattern 300A comprising stop point 310A. The selected appliqué stitch pattern 300A created by method 400 may resemble, for example, a mouse. After an operator selects an appliqué stitch pattern on the user interface 140 and begins to sew, processor 130 causes needle 160 to sew thread 170 onto workpiece 190 (not shown) into pattern portion 410, comprising a tail and whiskers connected by a straight line of stitches. After completion of portion 410, sewing machine 110 stops creating stitches. Needle 160 stops in the down position and presser foot 180 raises about 2 mm above workpiece 190. Point 415 of pattern portion 410 corresponds to where needle 160 is positioned after completion of pattern portion 410, and further corresponds to stop command 250. Thus, after completion of pattern portion 410, sewing machine 110 stops sewing.

When machine 110 stops sewing in response to a stop command in the stitch report, the operator may, in accordance with some embodiments, be prompted to take an action to facilitate completion of the embellishment. For example, a signal may be output on the user interface 140. The output may, for example, be an audible signal, or a pop-up window on the screen of user interface 140 that contains information on how and what the user should do. Additionally, or in the alternative, the operator may be prompted to take action by instructions provided in a user manual or some other provided source of instructions. The operator may, in some embodiments, request additional information by engaging a help function of the user interface that further assists the operator in completing the embellishment. Further, the operator may understand that the stopping of the machine in the needle down position with the presser foot incrementally raised is a signal to take a certain action in accordance with the selected stitch pattern.

In response to the operator signal, the operator then places a desired appliqué material 495 on top of workpiece 190 (not shown). The operator may receive further signals that prompt the operator. The operator then positions material 495 behind point 415 and thus behind needle 160 (not shown). The operator then continues to sew. By instructing the machine to resume sewing, the presser foot 180 moves back to the down position and needle 160 sews thread 170 onto material 495 into pattern portion 420. The stitches of pattern portion 420 affix material 495 to workpiece 190. Pattern portion 420 creates an appliqué; portion 420 affixes appliqué material 495 to workpiece 190, creates the mouse body and eyes, and is sewn between the tail and whiskers created by pattern portion 410.

After completion of pattern portion 420, an operator may repeat the stitch pattern. By continue to sew, the operator causes sewing machine 110 to repeat sewing pattern portion 410, stopping at the stop command, and when sewing is resumed by the operator, the sewing machine completes pattern portion 420. Portion 410 and portion 420 combine to form stitch pattern 430 including an appliqué embellishment. Repetition of pattern portions 410 and 420 create a plurality of appliqués 430, and are shown as embellishments resembling mice. There remains an excess of material 495 around the appliqué portion of the embellishment stitched by pattern portion 420. When an operator has embellished onto workpiece 190 a desired number of appliqués, for example, a desired number of mice, the operator can remove workpiece 190 having appliqué material 495 affixed to it from sewing machine 110. The operator can then remove excess material 495, by for example, trimming away the excess with shears, to create finished embellishment 450. In finished embellishment 450, the only material 495 that remains on workpiece 190 is the appliqué, and in this example, is the mouse body. The operator does not, however, have to stop embellishing after the creation of each appliqué to remove excess material because the stitch pattern portions, stops, and material placement ensure that excess material 495 does not inhibit the creation of sequential appliqués.

Figure 5:
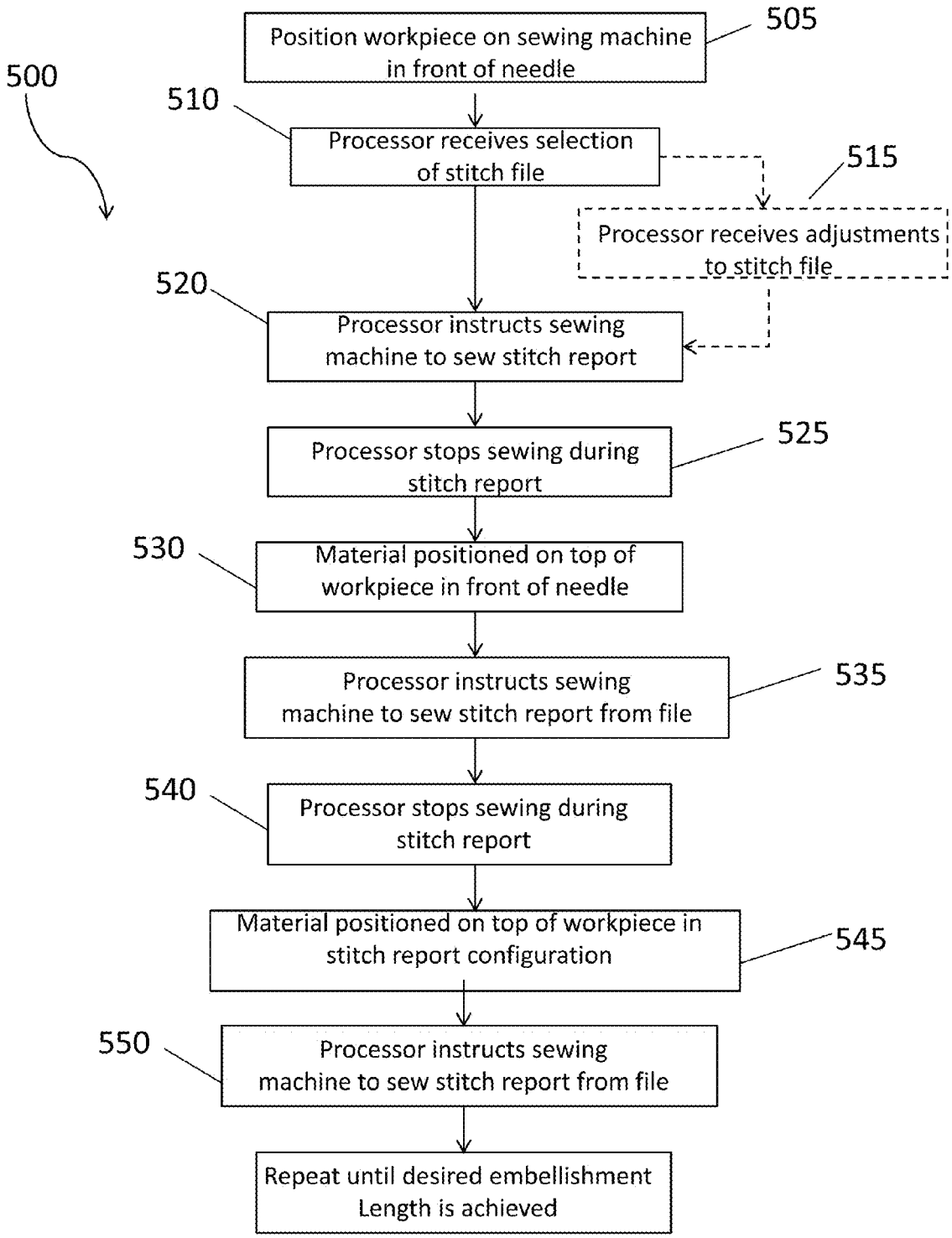
FIG. 5 shows a process of ribbon embellishment including processor-executable commands according to aspects and embodiments.

In accordance with aspects and embodiments, FIG. 5 shows process 500, executable by the stitching systems described herein. The commands of process 500 are described in relation to system 100 and its corresponding elements. Process 500 creates embellishments using a computerized sewing machine 110. Process 500 includes selections input into a sewing machine 110 by an operator that causes processor 130 to execute a series of commands to cause system 100 to create an embellishment. More specifically, process 200 creates a ribbon embellishment. Beginning with step 505, a workpiece to be embellished, such as workpiece 190, is positioned within the computerized sewing machine 110. Specifically, an operator may place workpiece 190 onto the sewing surface 150 such that the section of the workpiece to be embellished is positioned in front of the sewing needle 160.

At step 510, processer 130 of system 100 may receive a selection of a stitch pattern. In an optional step 515, the processor 130 may receive an adjustment to the selected stitch pattern. Processor 130 receives adjustments and alters the stitch report as needed.

After selecting a stitch pattern and making any necessary adjustments, an operator begins to sew. Starting to sew causes processor 130 to execute a command 520 that instructs sewing machine 110 to sew a first portion of the stitch pattern onto workpiece 190. Sewing needle 160 sews thread 170 from the spool into the pattern that corresponds to the processor-executed stitch report.

Processor 130 then executes a next command 525 that instructs sewing machine 110 to stop sewing after a first portion of the stitch pattern is complete. Sewing needle 160 stops in the needle down position and presser foot 180 raises off workpiece 190 in amount that allows an operator to perform step 530 and place a material in front of the sewing needle.

After an operator completes step 530, the operator resumes sewing. By causing the machine to resume sewing, the processor executes command 535 that instructs the machine to continue sewing the stitch report corresponding to the stitch pattern selected by the user. Processor 130 then executes command 540, a second stop command, causing sewing needle 160 to stop in the needle down position and raise presser foot 180. The operator then performs step 545 by manipulating the material such that it is again in front of the sewing needle.

After the material has been appropriately manipulated into the correct position and in front of sewing needle 160, the operator again resumes sewing. By causing the machine to resume sewing, the processor executes step 550 by executing a command that instructs the machine to continue sewing the stitch report corresponding to the stitch pattern selected by the user. The operator continues process 500 until a desired length of ribbon embellishment is achieved.

Figure 6:
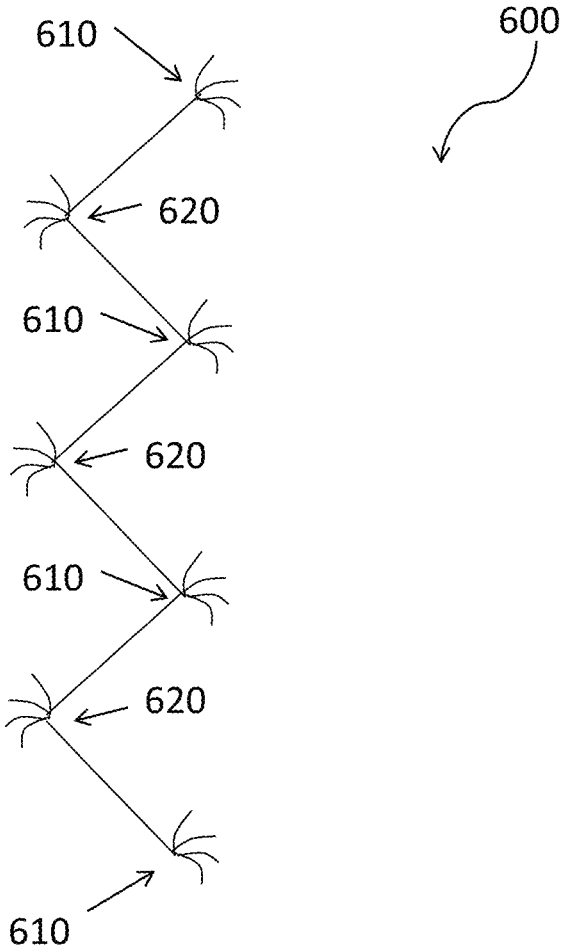
FIG. 6 shows a ribbon stitch pattern in accordance with aspects and embodiments.

For example and referring to FIG. 6, an operator may select a ribbon stitch pattern 600 that corresponds to a stitch report comprising a series of processor-executed commands in accordance with method 500. The operator may create a ribbon embellishment by performing method 700, shown in FIGS. 7A and 7B. The operator may perform method 700 to cause sewing machine 110 having processor 130 to execute a stitch report corresponding to pattern 600.

Ribbon stitch pattern 600 corresponds to a series of processor-executed commands that cause sewing machine 110 to stop at certain times in the stitch report. For example, ribbon stitch pattern 600 has two points that correspond to stops commands in the stitch report, points 610 and 620. Point 610 corresponds to stop command 525 and point 620 corresponds to stop command 540. After each stop in the ribbon stitch report, the operator places the ribbon material in front of sewing needle. The operator continues to sew, stop, manipulate the ribbon in front of the needle, and resume sewing.

Figure 7A:
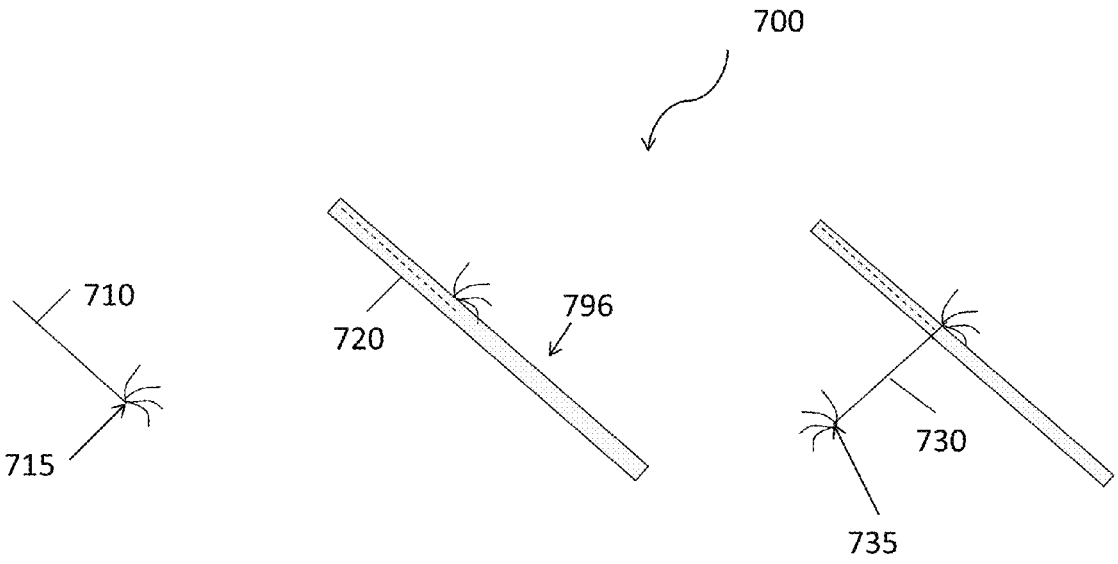
FIGS. 7A-7B show a method of ribbon embellishment in accordance with aspects and embodiments.
Figure 7B:
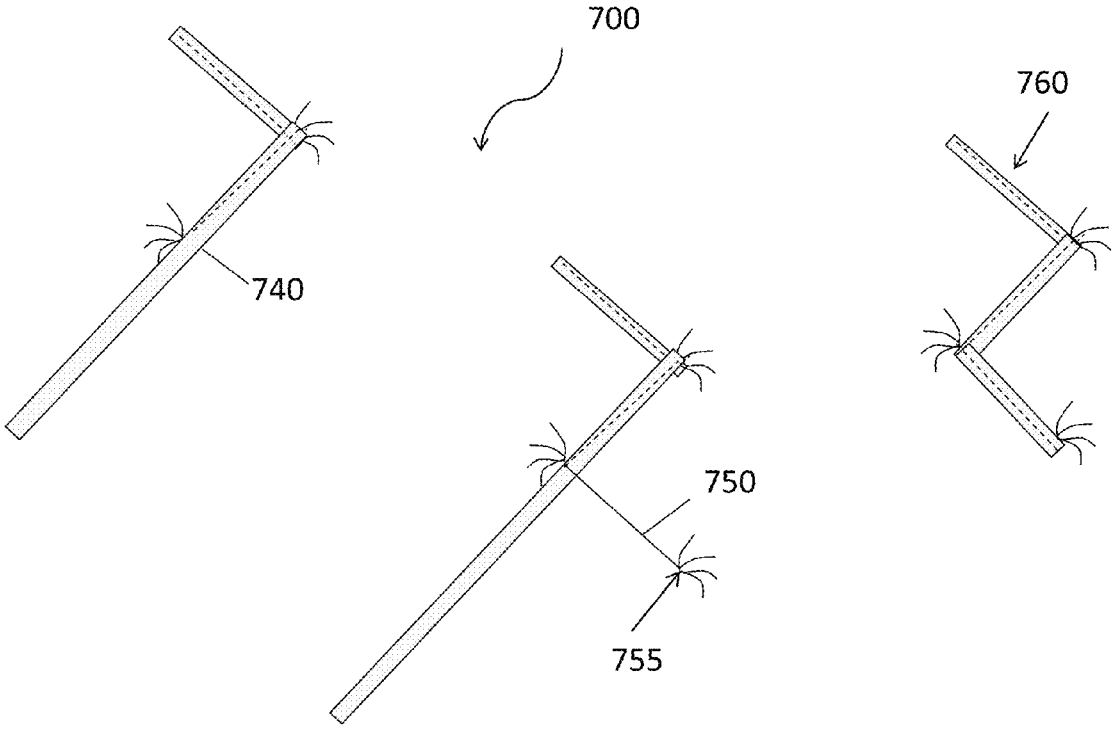

Referring to FIGS. 7A and 7B, after an operator selects a ribbon stitch pattern, for example, stitch pattern 600, and begins to sew, processor 130 causes needle 160 to sew thread 170 onto workpiece 190 into pattern portion 710. After completion of portion 710, sewing machine 110 stops creating stitches. Needle 160 stops in the down position and presser foot 180 raises. Point 715 of pattern portion 710 corresponds to where needle 160 is positioned after completion of pattern portion 710, and corresponds to stop command 560 at point 610. After completion of pattern portion 710, sewing machine 110 stops sewing.

The operator then places a desired ribbon material 796 on top of workpiece 190 (not shown) in response to an optional operator signal. In accordance with signals, the operator positions material 796 in front of point 715 and thus in front of needle 160 and aligns the ribbon 796 along or over the line stitched in portion 715. The operator then continues to sew. The presser foot moves back to the down position and needle 160 sews thread 170 onto material 796 into pattern portion 730. At least some of the stitches of pattern portion 730 affix ribbon 796 to workpiece 190.

After completion of pattern portion 730, sewing machine 110 again stops sewing. Point 735 of pattern portion 730 corresponds to stop command 540 and indicates where needle 160 is positioned after completion of pattern portion 730.

The operator, as shown in step 740, manipulates ribbon material 796 in response to received prompts such that material 796 aligns along or over the line stitched in portion 730 and is front of point 735 and thus in front of needle 160. The operator then continues to sew. The presser foot moves back to the down position and needle 160 sews thread 170 onto material 796 into pattern portion 750. At least some of the stitches of pattern portion 750 affix ribbon 796 to workpiece 190. Point 755 of pattern portion 750 corresponds to where needle 160 is positioned after completion of pattern portion 750. The operator can continue performing method 700 until a desired length of embellishment 760 is achieved.

Unlike traditional methods of applying ribbon with the use of a computerized sewing machine, the stitching systems and methods disclosed allow for a wider range of stitch patterns and more creative embellishments.

Figure 8:
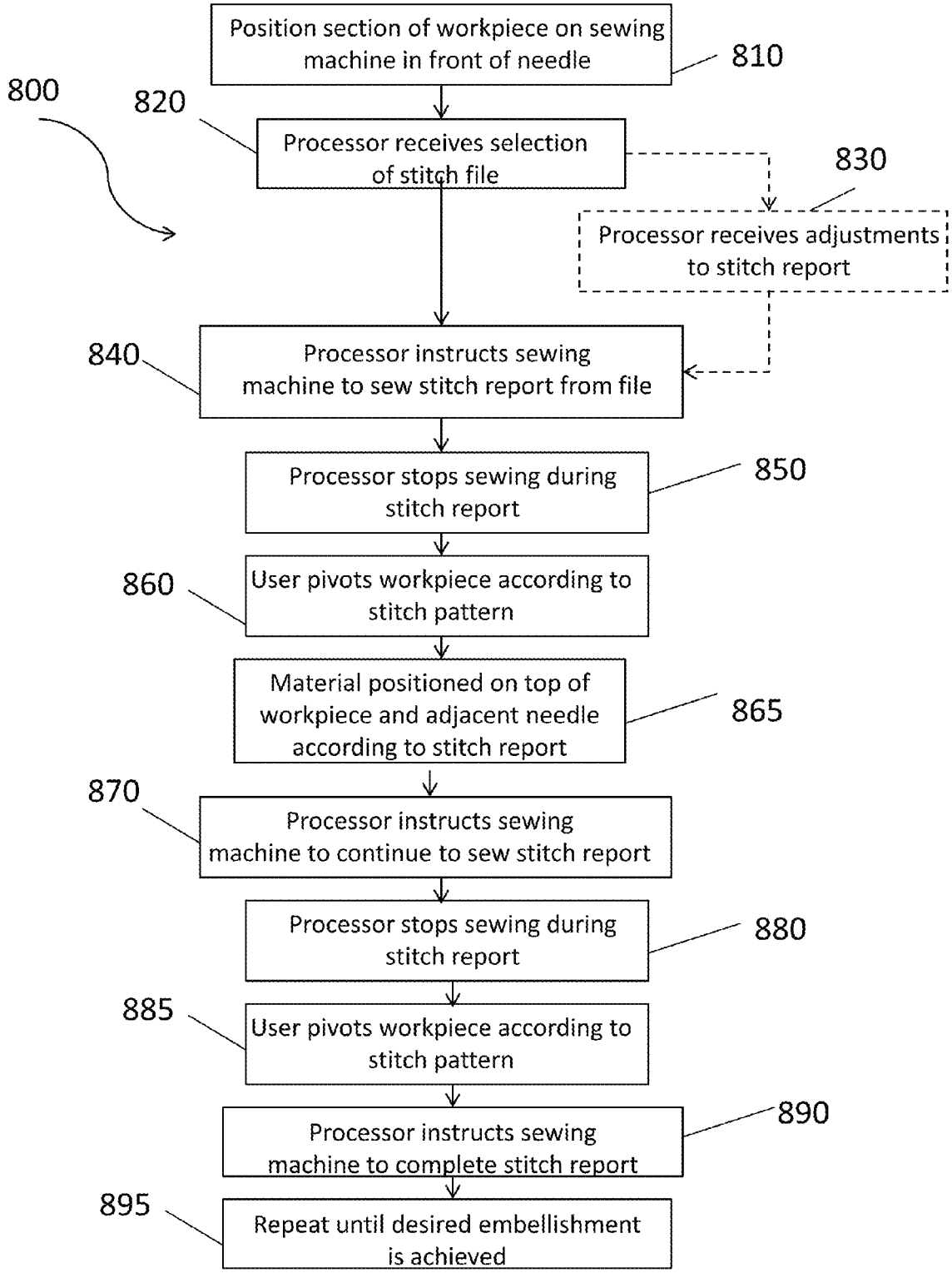
FIG. 8 shows a process of pop-up embellishment according to aspects and embodiments.

In accordance with aspects and embodiments, FIG. 8 shows process 800, executable by the stitching systems disclosed. The commands of process 800 are described in relation to system 100 and its corresponding elements. Process 800 creates embellishments using a computerized sewing machine. Process 800 includes selections input into sewing machine 110 by an operator that cause processor 130 to execute a series of commands to cause sewing system 100 to create an embellishment. More specifically, process 800 creates pop-up embellishments.

Beginning with step 810, a workpiece to be embellished, for example, workpiece 190, is positioned within the computerized sewing machine 110. Specifically, an operator may place workpiece 190 onto the sewing surface 150 such that the section of the workpiece to be embellished is positioned in front of the sewing needle.

At step 820, processer 130 of system 100 may receive a selection of a pop-up stitch pattern. In optional step 830, the processor 130 may receive an adjustment to the stitch pattern and processor 130 may alter the stitch report as needed.

After selecting a stitch pattern and making any necessary adjustments, an operator begins to sew. Starting to sew causes processor 130 to execute a command 840 that instructs sewing machine 110 to sew a first portion of the stitch pattern onto workpiece 190. Sewing needle 160 then sews thread 170 from the spool into the desired pattern that corresponds to the processor executed pop-up stitch report.

Processor 130 then executes a next command 850 that instructs sewing machine 110 to stop sewing after a first portion of the stitch pattern is complete. Sewing needle 160 stops in the needle down position and presser foot 180 raises off workpiece 190. In some embodiments and in accordance with step 860, the user may adjust the workpiece 190. In step 860, the operator pivots the fabric about the needle in response to a received signal. For example, the operator may pivot workpiece 190 90° clockwise. An operator may then, in accordance with step 865, place a pop-up material at an appropriate place in relation to needle 160.

After an operator completes step 865, the operator may resume sewing. By causing the machine to resume sewing, the processor is caused to execute command 870 that instructs the machine to continue sewing the stitch report corresponding to the pop-up stitch pattern selected by the user. Stitches completed in step 870 may affix the pop-up material to workpiece 190. After completion of command 870, the processor may execute command 880 that causes the sewing machine to again stop sewing. Sewing needle 160 may stop in the needle down position and presser foot 180 may rise off workpiece 190. An operator may complete step 885 by pivoting the workpiece 190 in accordance with a received signal. The operator then resumes sewing, which causes processor 130 to execute command 890 that causes the sewing machine to complete selected stitch report. Process 800 is repeated in step 895 until a desired number of pop-up embellishments are created.

Figure 9:
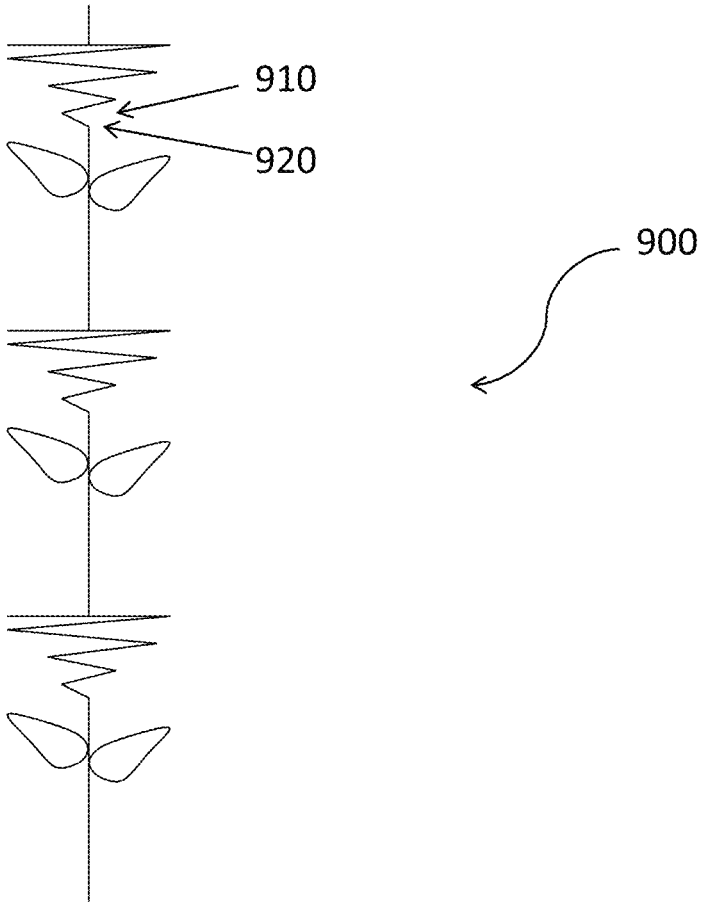
FIG. 9 shows a pop-up stitch pattern in accordance with aspects and embodiments.

For example and referring to FIG. 9, an operator may select, via user interface 140, a pop-up stitch pattern 900 that corresponds to a stitch report comprising a processor-executed series of commands in accordance with process 800.

Pop-up stitch pattern 900 corresponds to a series of processor-executed commands that cause sewing machine 110 to stop at certain times in the stitch report. For example, pop-up stitch pattern 900 has two points that correspond to stops commands in the stitch report, points 910 and 920. Point 910 corresponds to stop command 850 and point 920 corresponds to stop command 880. After the first stop in the stitch report, the operator adjusts the workpiece and places pop-up material adjacent and to the right of the needle. At the second stop, the operator re-orients the workpiece. The operator continues to sew, stop, manipulate the workpiece, add pop-up fabric, sew, stop, reorient the fabric and resume sewing.

Figure 10A:
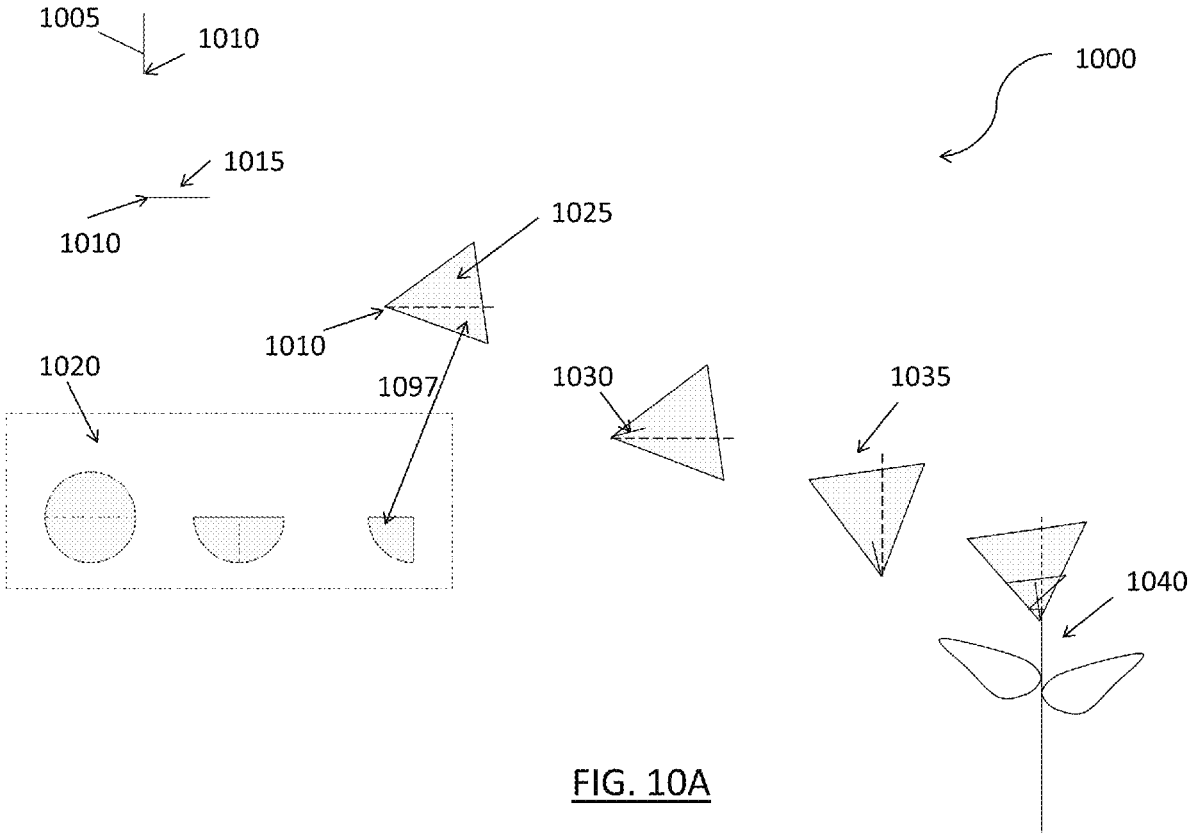
FIGS. 10A-10B show a method of pop-up embellishment in accordance with aspects and embodiments.
Figure 10B:
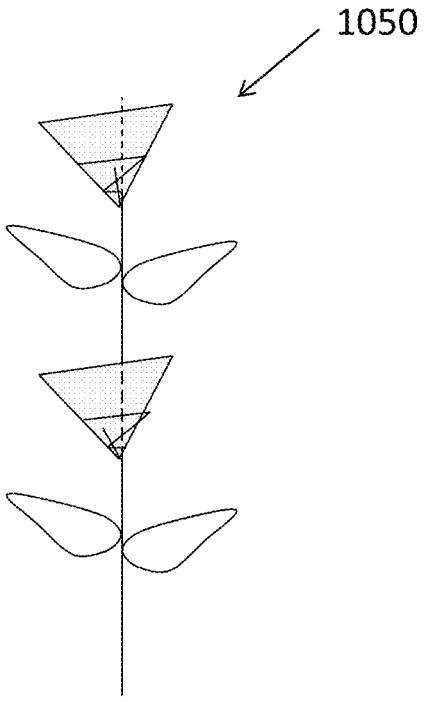

Referring to method 1000 FIG. 10A, an operator cause sewing machine 110 having processor 130 to execute a stitch report corresponding to a pop-up embellishment, for example stitch pattern 900. After an operator selects pattern 900 and begins to sew, processor 130 causes needle 160 to sew thread 170 onto workpiece 190 into pattern portion 1005. After completion of portion 1005, sewing machine 110 stops creating stitches. Needle 160 stops in the down position and presser foot 180 raises. Point 1010 of pattern portion 1005 corresponds to where needle 160 is positioned after completion of pattern portion 1005. Thus, after completion of pattern portion 905, sewing machine 110 stops sewing.

In step 1015, the operator pivots the fabric 90° clockwise in response to signals, such that pattern portion 1005 is to the right of needle 160. In step 1020, the operator follows signals, for example, prompts output by the machine displayed on a screen of the user interface 140, and takes a piece of pop-up material 1097 and folds it into a shape according to the pop-up stitch pattern. The operator then, as prompted, places the folded pop-up material 1097 adjacent and to the right of needle 160 (not shown) in step 1025. The operator then resumes sewing in step 1030 such that at least a portion of the stitches completed by sewing machine 110 in step 1030 affix pop-up material 1097 to workpiece 190. Sewing machine 110 again stops after completion of portion 1030, and in subsequent step 1035, the operator is prompted to pivot the workpiece 90° counter-clockwise about needle 160 to return the workpiece to its original orientation. The operator then resumes sewing in step 1040 to complete a single pop-up embellishment. The operator may, in accordance with embodiments, desire a running sequence of pop-up embellishments. The operator may repeat method 1000 to produce a plurality of pop-up stitches 1050.

The systems and methods described herein may be combined to create unique embellishments. For example, an operator may combine an appliqué stitch with a pop-up stitch to create a new, user-generated design. Additionally, an operator may adjust a stitch report to cause the processor 130 to, rather than start sewing the first portion of a stitch pattern, instead start sewing the second section of a stitch pattern. The operator is therefore not limited to the exact stitch pattern and may create an embellishment that starts differently than a pre-programmed stitch pattern.

An operator may also use the systems and methods described in conjunction with a shape-creator mode (e.g. shaping feature) of sewing machine 110. An example of such a shape-creating program for a sewing machine is detailed in U.S. Patent Publication No. 2011/0041746 titled "Positioning of Stitch Data Objects," assigned to VSM Group AB, the entirety of which is herein incorporated by reference. The shaping feature of sewing machine 110 may enable an operator to create customizable embellishments on workpieces that resemble operator-generated designs. An operator may be able to employ the user interface 140 to design a custom appliqué stitch, a custom ribbon stitch, a custom pop-up stitch, or any other type of embellishment. The shape creator program may then convert the pattern created by the user into a stitch report that can be executed by the processor. The stitch program may generate a new stitch file comprising both the pattern and the processor executable stitch report. The stitch creator program may include, in the generated stitch report, signals to the operator to assist the operator in completing the embellishment.

Once a user has created a new stitch pattern, the operator may save the stitch file containing the visual representation and the stitch report in memory 120 for later use. These features allow for easy duplication of user-generated designs. As opposed to creating each design before each use, the shaping feature allows for automatic, repeated, creation of embellishments on workpieces. Manual reproduction of these embellishments would be time-consuming and lack the accuracy of a computer-assisted shape creating feature. Thus, the systems and methods described herein allow the user to create, and accurately recreate, unique decorative embellishments.

Existing sewing machines may be retrofitted with the systems and methods of the present disclosure. For example, a sewing machine having a processor and memory may be capable of receiving new stitch files, where a stitch file comprises both the visual representation of the pattern displayed to the user on the user interface and the stitch report executable by the processor. A sewing machine may receive stitch files in accordance with aspects and embodiments by connecting the machine to the internet and downloading the stitch files, the stitch files may be uploaded to the machine from an external source, or may be executed by the processor directly from an external source in communication with the machine.

Having now described some illustrative embodiments, it should be apparent to those skilled in the art that the foregoing is merely illustrative and not limiting, having been presented by way of example only. Numerous modifications and other embodiments are within the scope of one of ordinary skill in the art and are contemplated as falling within the scope of the invention. In particular, although many of the examples presented herein involve specific combinations of processes, method acts or system elements, it should be understood that those acts and those elements may be combined in other ways to accomplish the same objectives.

Moreover, it should also be appreciated that the invention is directed to each feature, system, subsystem, or technique described herein and any combination of two or more features, systems, subsystems, or techniques described herein and any combination of two or more features, systems, subsystems, and/or methods, if such features, systems, subsystems, and techniques are not mutually inconsistent, is considered to be within the scope of the invention as embodied in any claims. Further, acts, elements, and features discussed only in connection with one embodiment are not intended to be excluded from a similar role in other embodiments. Furthermore, those skilled in the art should appreciate that the processes and methods described herein are exemplary and that actual processes and/or methods will depend on the specific application in which the systems and techniques of the invention are used. Those skilled in the art should also recognize or be able to ascertain, using no more than routine experimentation, equivalents to the specific embodiments of the invention. It is, therefore, to be understood that the embodiments described herein are presented by way of example only and that the invention may be practiced otherwise than as specifically described.

Also, the phraseology and terminology used herein is for the purpose of description and should not be regarded as limiting. Any references to embodiments or elements or acts of the systems, processes, and methods herein referred to in the singular may also embrace embodiments including a plurality of these elements, and any references in plural to any embodiment or element or act herein may also embrace embodiments including only a single element. The use herein of "including," "comprising," "having," "containing," "involving," and variations thereof is meant to encompass the items listed thereafter and equivalents thereof as well as additional items. Any references to positional or spatial orientation are intended for convenience of description, not to limit the present apparatus and methods or their components.

What is claimed is:

1. A method for decorative sewing with a sewing machine, the method comprising:

positioning a workpiece on the sewing machine;

selecting an appliqué stitch pattern;

inputting the selected stitch pattern into the sewing machine through a user interface;

operating the sewing machine to sew a first portion of the selected stitch pattern onto the workpiece;

receiving from the sewing machine a signal after the first portion of the selected stitch pattern is completed;

operating the sewing machine to sew a second portion of the stitch pattern onto the workpiece and affix the appliqué material to the workpiece after receiving the signal from the sewing machine; and removing excess affixed appliqué material from the workpiece.

2. The method of claim 1, wherein sequential appliqués are affixed to the workpiece without first removing excess appliqué material.

3. A method for decorative sewing with a sewing machine, the method comprising:

positioning a workpiece on the sewing machine;

selecting a ribbon stitch pattern;

inputting the selected stitch pattern into the sewing machine through a user interface;

operating the sewing machine to sew a first portion of the selected stitch pattern onto the workpiece;

receiving from the sewing machine a signal after the first portion of the selected stitch pattern is completed; and operating the sewing machine to sew a second portion of the stitch pattern onto the workpiece after receiving the signal from the sewing machine.

4. The method of claim 3, wherein operating the sewing machine to sew the second portion of the stitch pattern onto the workpiece affixes a ribbon material to the workpiece.

5. A method for decorative sewing with a sewing machine, the method comprising:

positioning a workpiece on the sewing machine;

selecting a pop-up stitch pattern;

inputting the selected stitch pattern into the sewing machine through a user interface;

operating the sewing machine to sew a first portion of the selected stitch pattern onto the workpiece;

receiving from the sewing machine a signal after the first portion of the selected stitch pattern is completed; and operating the sewing machine to sew a second portion of the stitch pattern onto the workpiece after receiving the signal from the sewing machine.

6. The method of claim 5, wherein operating the sewing machine to sew the second portion of the stitch pattern onto the workpiece affixes a pop-up material to the workpiece.

* * * * *